United States Patent [19]

Okado et al.

[11] Patent Number: 4,654,744

[45] Date of Patent: Mar. 31, 1987

[54] ELECTROMAGNETIC CONTACTOR

[75] Inventors: Hiroyuki Okado, Owariasahi; Shizutaka Nishizako, Tajimi; Yuji Sako; Masahiro Kakizoe, both of Kasugai, all of Japan

[73] Assignee: Mitsubishi Denki Kabushiki Kaisha, Tokyo, Japan

[21] Appl. No.: 608,696

[22] PCT Filed: Oct. 14, 1983

[86] PCT No.: PCT/JP83/00346

§ 371 Date: May 2, 1984

§ 102(e) Date: May 2, 1984

[87] PCT Pub. No.: WO84/01661

PCT Pub. Date: Apr. 26, 1984

[30] Foreign Application Priority Data

| | | | |
|---|---|---|---|
| Oct. 15, 1982 | [JP] | Japan | 57-155985 |
| Oct. 15, 1982 | [JP] | Japan | 57-155987 |
| Oct. 15, 1982 | [JP] | Japan | 57-155988 |
| Oct. 25, 1982 | [JP] | Japan | 57-187060 |
| Dec. 10, 1982 | [JP] | Japan | 57-216556 |

[51] Int. Cl.[4] ..... H01H 47/10

[52] U.S. Cl. ..... 361/159; 361/194; 335/131

[58] Field of Search ..... 335/131, 132; 361/159, 361/194

[56] References Cited

U.S. PATENT DOCUMENTS

| | | | |
|---|---|---|---|
| 3,717,829 | 2/1973 | Flaherty | 335/187 |
| 3,832,657 | 8/1974 | Hardman et al. | 335/99 |
| 4,481,555 | 11/1984 | Yoshida et al. | 361/194 |

FOREIGN PATENT DOCUMENTS

| | | |
|---|---|---|
| 39-4774 | 4/1964 | Japan . |
| 50-70853 | 6/1975 | Japan . |
| 55-14297 | 6/1980 | Japan . |

*Primary Examiner*—L. T. Hix
*Assistant Examiner*—David M. Gray
*Attorney, Agent, or Firm*—Wenderoth, Lind & Ponack

[57] ABSTRACT

An electromagnetic contactor for controlling the opening and closing of an electric circuit for an electric motor or the like, including a mounting pedestal including a rectifier circuit therein, a stationary iron core disposed thereon and having an operating coil wound around the same, and a movable iron core disposed oppositely to this stationary iron core to be spaced therefrom by a predetermined spacing thereby to change an AC voltage applied to the operating coil to a direct current. The stationary iron core is composed of a bar-shaped magnetic member while the movable iron core is substantially U-shaped.

12 Claims, 15 Drawing Figures

FIG. 1 (a) PRIOR ART
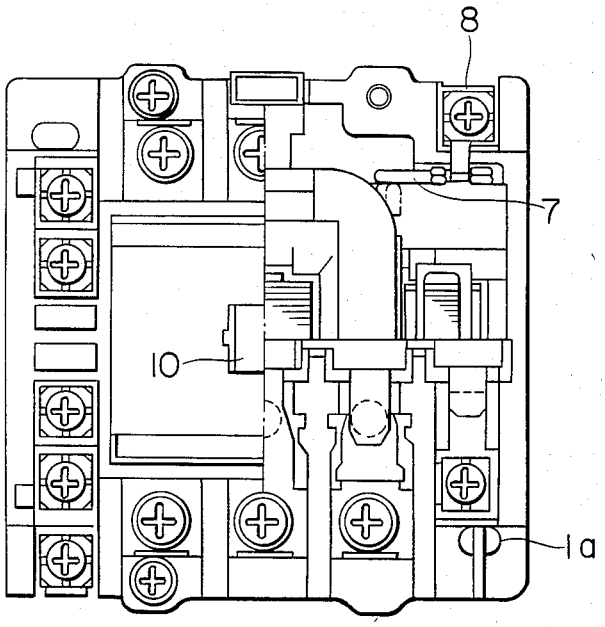

FIG. 1 (b) PRIOR ART
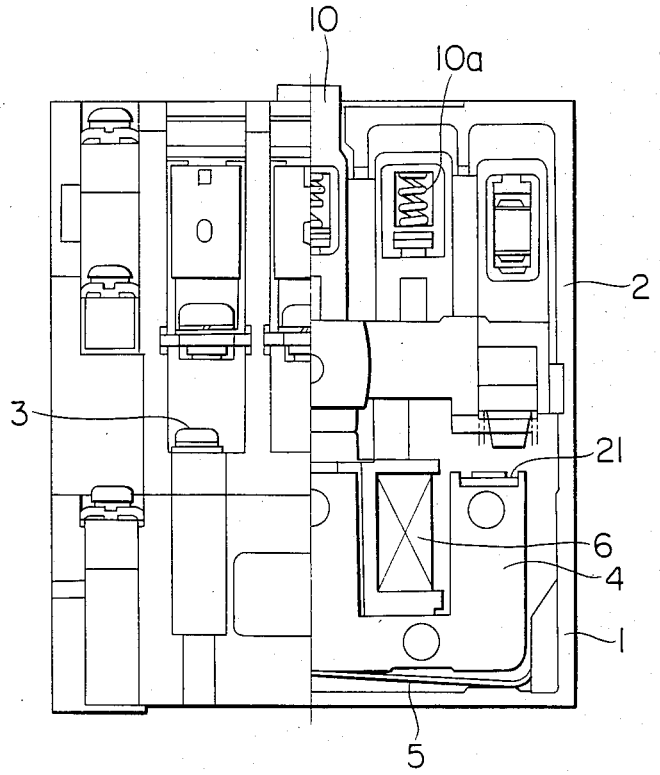

FIG. 1 (c) PRIOR ART
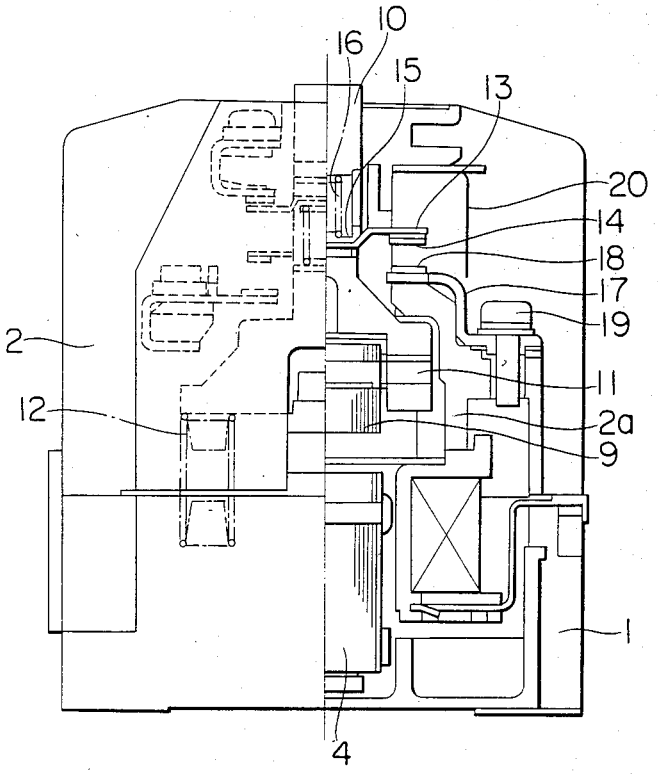

ELECTROMAGNETIC CONTACTOR

TECHNICAL FIELD

This invention relates to an electromagnetic contactor for controlling the opening and closing of an electric circuit for an electric motor or the like. More particularly it concerns an electromagnetic contactor comprising a mounting pedestal having a rectifier circuit disposed therein, a stationary iron core disposed on the mounting pedestal and having an operating coil wound around the same, and a movable iron core disposed oppositely to this stationary iron core to be spaced therefrom by a predetermined spacing and always urged away from the stationary iron core side by means of a kickout spring, whereby an AC voltage applied to the operating coil is changed to a direct current.

PRIOR ART

FIGS. 1(*a*)–1(*c*) show a conventional electromagnetic contactor. In the Figures reference numeral 1 designates a box shaped mounting pedestal formed of an insulating material, provided with a plurality of mounting holes 1*a* in order to mount the main body of the electromagnetic contactor on a mounting panel or the like. A base 2 is fixed to the mounting pedestal 1 by fastening screws 3, the base being composed of an insulated material. A stationary iron core 4 in the shape of an E is formed of silicon steel laminations stacked on one another, a buffer spring 5 is disposed between this stationary iron core 4 and the mounting pedestal 1, and an operating coil 6 is disposed around a central leg of the E-shaped stationary iron core 4 and held by having its lower surface abutting against the stationary iron core 4 and its upper surface abutting against the base 2. Leads 7 are provided for connecting this operating coil 6 to coil 6 to coil terminals 8, and a movable iron core 9 is disposed oppositely to the stationary iron core 4 to have a predetermined spacing therebetween and constructed so that, when a driving voltage is applied to the operating coil 6, it is attracted by the stationary iron core 4. A cross bar 10 formed of an insulating material is connected to the movable iron core 9 through a pin 11. A kickout spring 12 disposed between the cross bar 10 and the mounting pedestal 1 acts to urge the cross bar 10 upward as viewed in the figures. A movable contactor 13 provided with a movable contact 14, is inserted into a holding hole 10*a* provided on the cross bar 10 and pressurized by a contactor spring 16 held by a spring support 15. A stationary contactor 17 provided with a stationary contact 18 opposing the movable contact 14 is fixed to the base 2 by means of its elasticity while having a terminal screws 19 for connection to an electrical wire for the main circuit. An arc runner 20 consisting of a magnetic metal 15 provided for a purpose of extinguishing an electric arc. The runner is fixed to the base 2 by means of its spring action.

Since the conventional electromagnetic contactor has the structure as described above, the application of a driving voltage to the operating coil 6 causes the generation of an electromagnetic attraction between the stationary iron core 4 and the movable iron core 9 due to a magnetic flux generated by this operating coil 6 thereby to attract the movable iron core 9 by the stationary iron core 4 against the kickout spring 12. This is followed by the cross bar 10 connected to the movable iron core 9 being moved to the side of the stationary iron core 4 to cause the movable contact 14 on the movable contactor 13 held by the cross bar 10 to abut against the stationary contact 18 on the stationary contactor 17. At that time, an iron core gap between the movable iron core 9 and the stationary iron core 4 is made up so as to be larger than a contact gap between the movable contact 14 and the stationary contact 18. Therefore, upon the closure of the iron cores, the cross bar 10 is moved more to the side of the stationary iron core 4 than the position where said contacts abut against each other. This causes the contact spring 16 to be compressed and deformed. This spring pressure is transmitted to the movable contactor 13 to close the contacts with a predetermined contact pressure obtained.

Then, upon removing the driving voltage applied to the operating coil 8, the electromagnetic force disappears between the stationary iron core 4 and the movable iron core 9 to move the cross bar 10 away from the stationary iron core by means of a spring energizing force to the kickout spring 12 under a compressed state. Thus, the contacts are separated from each other. At that time, an electric arc is generated between the movable contact 14 and stationary contact 18 but this electric arc stretches along the arc runner 20 adjacent to said contact portions to be cooled and cut into pieces until it is extinguished.

In said electromagnetic contactor, however, the driving voltage is of an alternating current and therefore, in order to prevent the iron cores from vibrating due to its alternating magnetic flux, a shading coil 21 has been disposed on a contacting pole surface of the iron core to smooth a pulsating attraction due to the alternating magnetic flux. However, the effectiveness of the shading coil 21 has a limit. For example, upon occurrence of the rust on the contacting pole surface of the iron core, the smoothing effect decreases to cause vibrations of the iron cores. Thus, noise has been generated in the exterior. To this end, it has been that a proposed rectifier circuit be included in the mounting pedestal to change an AC voltage applied to the operating coil 6 to a direct current.

However, since the mounting pedestal 1 has the stationary iron core 4, the buffer spring 5 and the operating coil 6 and others included therein as shown in the FIGS. 1(*a*)–1(*c*) it has been difficult to ensure sufficient space for mounting said rectifier circuit.

SUMMARY OF THE INVENTION

In view of the abovementioned considerations, the present invention provides an electromagnetic contactor which has eliminated the above mentioned problems of the conventional electromagnetic contactor problems by composing the stationary iron core of a bar-shaped magnetic member and therewith making up a movable iron core disposed oppositely thereto into the form of a U and in addition, provides improvements in the ability of the electromagnetic contactor to be assembled and handled. so as to accommodate said rectifier circuit and its accessories in the interior of a mounting pedestal.

BRIEF DESCRIPTION OF THE DRAWING

FIGS. 1(*a*), 1(*b*) and 1(*c*) are outline views of a conventional electromagnetic contactor wherein FIG. 1(*a*) is a half plan and half sectional view, FIG. (*b*) is a half front elevational and half sectional view and FIG. 1(*c*) is a half side elevational and half sectional view.

FIGS. 2 through 11 are views illustrating one embodiment of an electromagnetic contactor according to the present invention wherein:

FIG. 2 is a diagram of a control circuit for an operating coil;

FIG. 3 is a plan view, partly in section, of the electromagnetic contactor;

FIG. 4 is a sectional view taken on the line IV—IV of FIG. 3;

FIG. 5 is a sectional view taken on the line V—V of FIG. 3;

FIG. 6 is an exploded perspective view of an electromagnetic portion;

FIG. 7 is a perspective view of the operating coil as viewed generally in the direction of the arrow on the line VII—VII of FIG. 6;

FIG. 8 is an enlarged perspective view of a change-over switch;

FIG. 9 is an enlarged perspective view of a stationary iron core;

FIG. 10 is an enlarged perspective view illustrating a stationary iron core support; and FIG. 11 is an exploded perspective view illustrating the manner in which a kickout spring bearing is mounted to a mounting pedestal.

DETAILED DESCRIPTION OF THE PREFERRED EMBODIMENT

A description will hereinafter be made of one embodiment of the present invention and with reference to the drawings.

Figure 2:
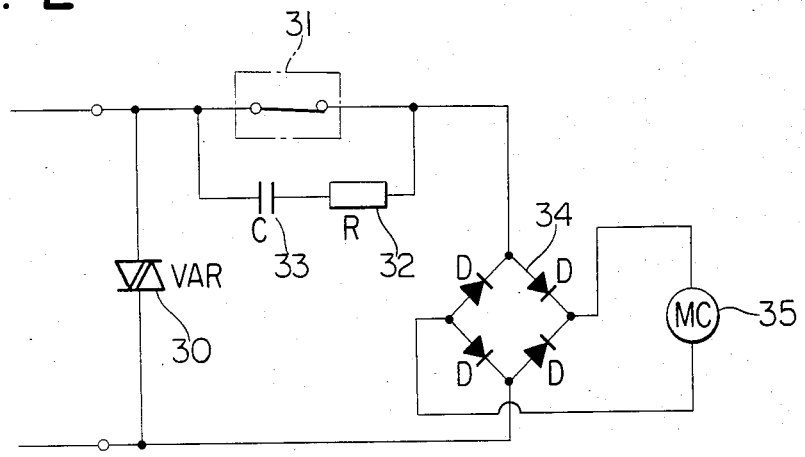
Figure 3:
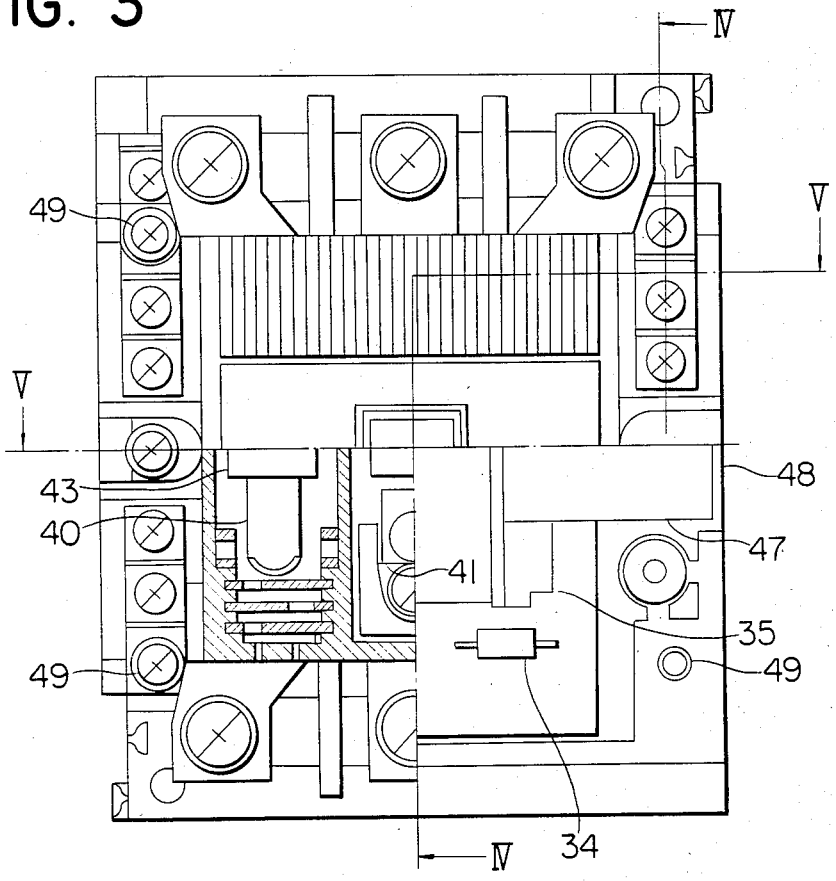
Figure 4:
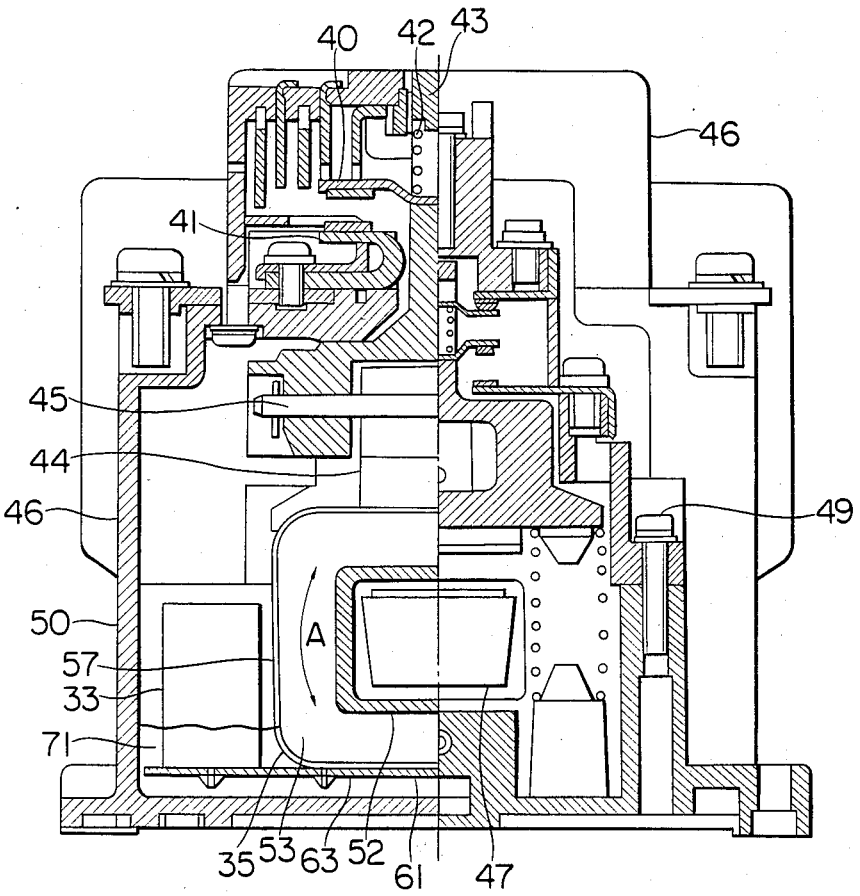
Figure 5:
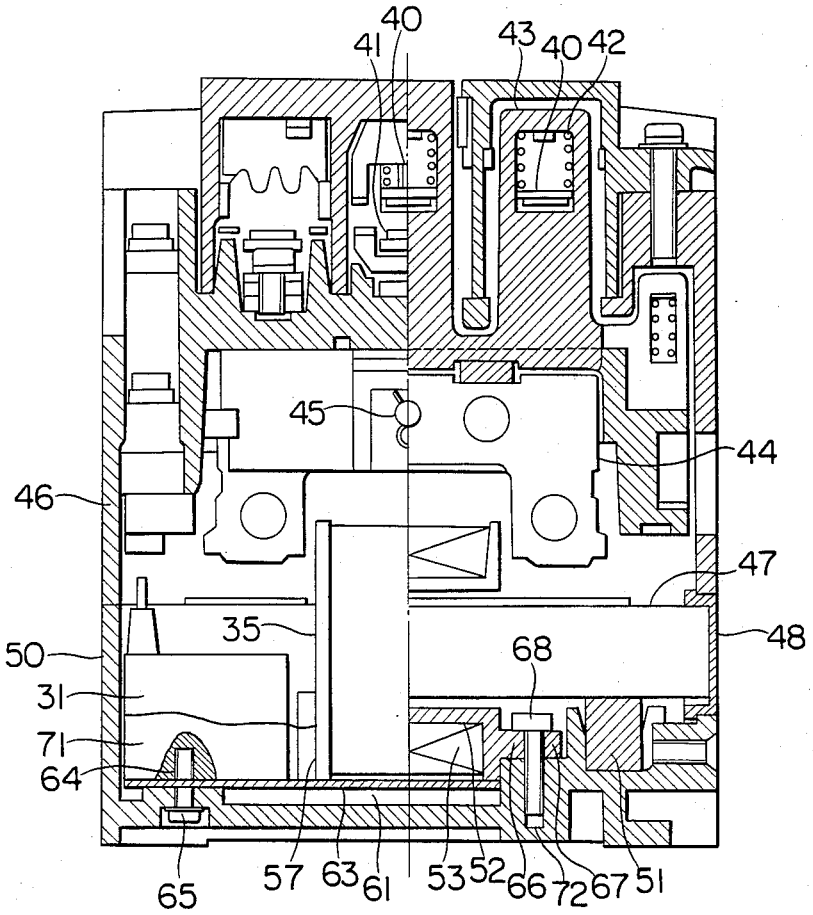
Figure 6:
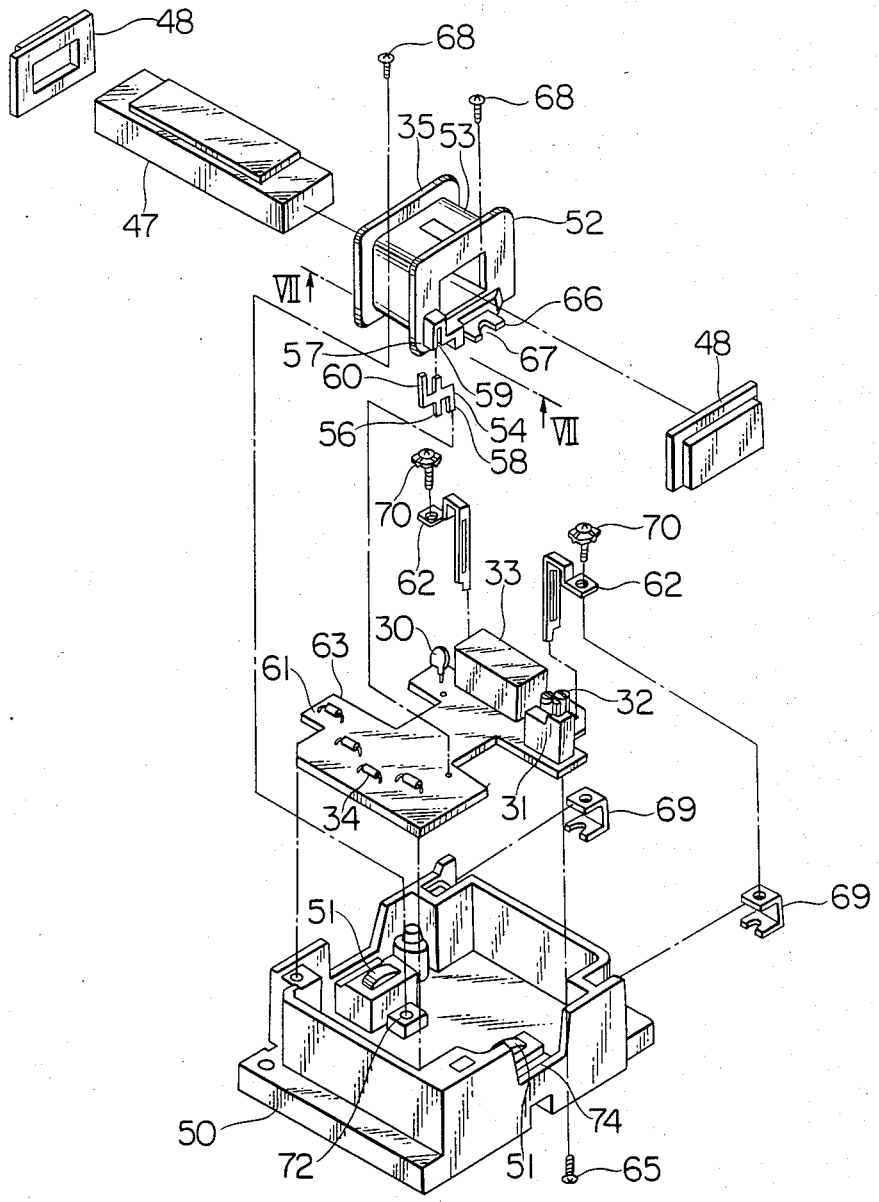

Referring first to FIG. 2, the description will be made in conjunction with a circuit for an electromagnet. The circuit components are composed of a varistor 30, a change-over switch 31, a resistance 32, a capacitor 33, a diode 34 and an operating coil 35. The change-over switch 31 is closed when the main contacts are open and also open when the main contacts are closed. The capacitor 33 and the resistance 32 are serially connected to each other and also connected in parallel to the change-over switch 31. The diode 34 full-wave rectifies an AC voltage and is connected at DC output terminals thereof to the operating coil 35 and the varistor 30 is connected to the AC side in order to prevent an intrusion of an external surge.

When an AC voltage is applied to the construction as described above, the operating coil 35 first has applied thereto the entire voltage formed only of the full-wave rectified AC voltage because the change-over switch 31 is closed. Thus, a movable part of the electromagnetic contactor is driven with an electromagnetic force to close the main contacts and simultaneously open the change-over switch 31. With the change-over switch 31 open, the AC voltage is applied to the diode 34 through the capacitor 33. Since the operating coil 35 has applied thereto an AC voltage dropped in voltage due to the capacitor 33, the movable part is held with a weak electromagnetic force as compared with the time while the change-over switch 31 is closed. Thus, the electric power consumed by the operating coil 35 becomes low. In electromagnets having the operating coil 35 directly receiving an AC voltage, the operating coil 35 has its magnetomotive force and electric power consumption changed with a variation in reactance between the closing and holding open of the change over switch but for DC excitation, it is required to change the voltage applied to the operating coil 35 by the change-over switch 31 or the like as described above.

Then, upon terminating the AC voltage, said movable part is returned back to its original state while at the same time the change-over switch 31 is closed to discharge an electric charge remaining on the capacitor 33 to the change-over switch 31 through the resistance 32 to electrically remove electric insulations produced on the contact surfaces of the change-over switch 31. At this time, the resistance 32 limits the magnitude of discharging current so as not to fusion weld the contacts.

Referring now to FIGS. 3 through 11 the construction of the electromagnetic contactor according to the present invention will be described.

The main contacts are composed of a movable contact 40 and a stationary contact 41 and the movable contact 40 is pressed by a pressing spring 42 and held by a cross bar 43. The cross bar 43 connects to a movable iron core 44 substantially in the shape of an angular U forming a magnetic path, by means of a pin 45, and therewith is slidably assembled into a base 46. A linearly barshaped (straight) stationary iron core 47 having a section substantially in the shape of a trapezoid is disposed to oppose the movable iron core 44, and stationary iron core supports 48 inserted into both ends thereof are fixed by carrying them between the base 46 fixed by screws 49 and the mounting pedestal 50. Each support 48 has a convex surface abutting an end of the stationary iron 47. Fixing rubber buffers 51 are disposed at the bottom of the mounting pedestal 50 to press the stationary iron core 47.

Figure 7:
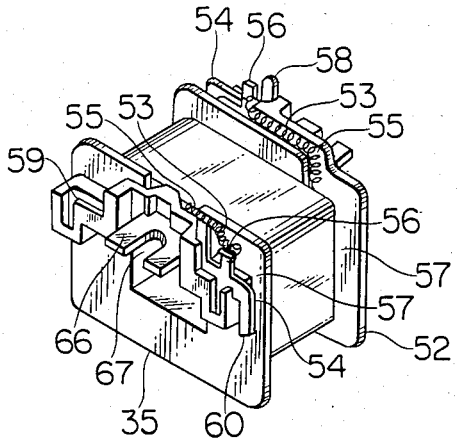

As shown in the details thereof in FIG. 7, the operating coil 35 is composed of a coil spool 52, a winding 53, and coil leads 54. After the winding 53 has been wound around the coil spool 52, the same is passed through grooves 55 disposed on the coil spool 52 and connected to protrusions 56 and electrically conducting coil leads 54.

The groove 55 is provided on a flange 57 of the coil spool 52 below the stationary iron core 47 so as not to interfere with the movable iron core 44. A protrusion 58 is disposed on the coil lead 54 to be inserted into and fixed in a hole 59 disposed on the coil spool 52. Also, a terminal protrusion 60 is caused to protrude along the flange 57 to the base side whereby the same is arranged to be able to be utilized as a terminal for measuring a windings resistance of the operating coil 35.

The operating coil 35 constructed as described above is connected to a printed substrate 61 by the protrusions 58 on the coil leads 54 while being arranged with the stationary iron core 47 extending therethrough. The printed substrate 61 is equipped with, in addition to the operating coil 35, the varister 30, the changeover switch 31, the resistance 32, the capacitor 33 and the diode 34, which are the components used for the control of the operating coil 35 and coil terminals 62 for applying the AC voltage. This printed substrate assembly 63 is assembled into the interior of the mounting pedestal 50 which is made up in the form of the box while the change-over switch 31 is provided with a female screw thread 64 (see FIG. 5) so that the position of the change-over switch 31 is controlled by fastening it to the mounting pedestal 50 through the printed substrate 61 by means of a screw 65.

Furthermore, the flange 57 of the coil spool 52 is provided on both lateral surfaces thereof with protrusion 66 which is provided with a notch 67. By fastening a screw 68 in a female screw thread 72 (see FIG. 5) formed in the mounting pedestal 50, the operating coil 35, which is large in weight, is fixed to the mounting pedestal 50. The coil terminals 62 (see FIG. 6) are fastened to relaying terminals 69 forcedly inserted into the mounting pedestal 50 by means of coil terminal screws 70 whereby it is possible to connect the electromagnet to an external electric source.

In order to protect each component equipped on the printed substrate assembly 63 fixed to the mounting pedestal 50 as described above against impulses due to a closure of the electromagnetic contactor itself, an epoxy resin 71 is poured into the mounting pedestal 50 (which as noted above is made up into the form of the box). The present inventors have experimentally conformed that the epoxy resin 71 does not leak from the mounting pedestal 50 through which the screws 65 extend.

Figure 8:
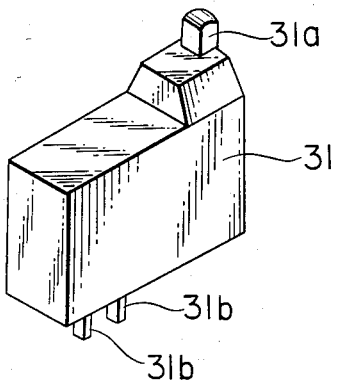

FIG. 8 shows a perspective view of the change-over switch 31. This change-over switch 31 has a pushbutton part 31*a* on the upper portion. This pushbutton part 31*a* is disposed so as to be pressed against the lower end of the cross bar 43 so that its contacts are open just before a position of attraction of the iron core. Also it has pin-shaped terminals (31*b*) on the lower portion, which terminals are constructed so as to be connected to the printed substrate 61 by direct soldering.

Figure 9:
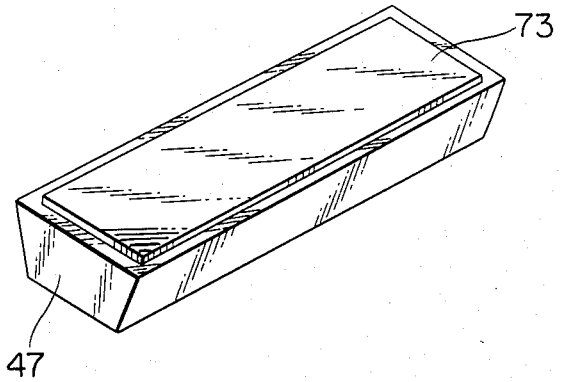

Also, FIG. 9 shows a perspective view of the stationary iron core 47 which is in the shape of a linearly extending bar having a trapezoidal sectional profile and which has contact pole surface to which a non-magnetic spacer 73 is stuck in order to prevent the iron core from falling with a delay, the spacer 73 being formed of a non-magnetic sheet metal such as a stainless steel or the like. This stationary iron core 47 is inserted into the operating coil 35 through an opening 74 (see FIG. 6) on the lateral surface of the mounting pedestal 50 with the opening closed by one of the stationary iron core supports 48.

Figure 10:
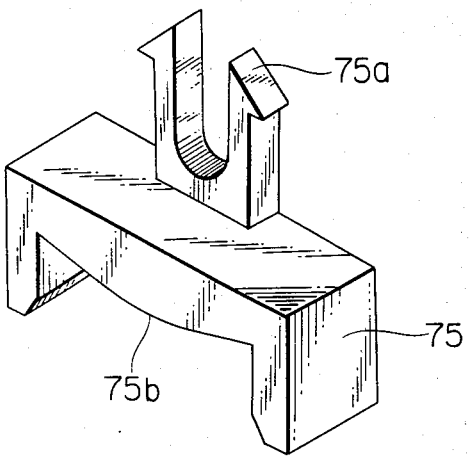

FIG. 10 is an enlarged perspective view illustrating a stationary iron core support 75 consisting of a material having a small Young's modulus (for example, a thermal plastic resin or the like) and fixed to the base 46 by means of a snap action of its pawl 75*a* with the lower end surface 75*b* being curved so as to abut against the contact pole surface of the stationary iron core 47 to position the latter. Accordingly, said stationary iron core 47 can be rotated in the direction of the arrow A shown in FIG. 4 and therefore can intimately contact a contact pole surface of the movable iron core 44, which core is disposed oppositely to the same and is made up into the form of a U without any clearance therebetween. Thus, the attraction characteristics can be arranged to be stabilized under the state of mutual attraction between the iron cores.

Figure 11:
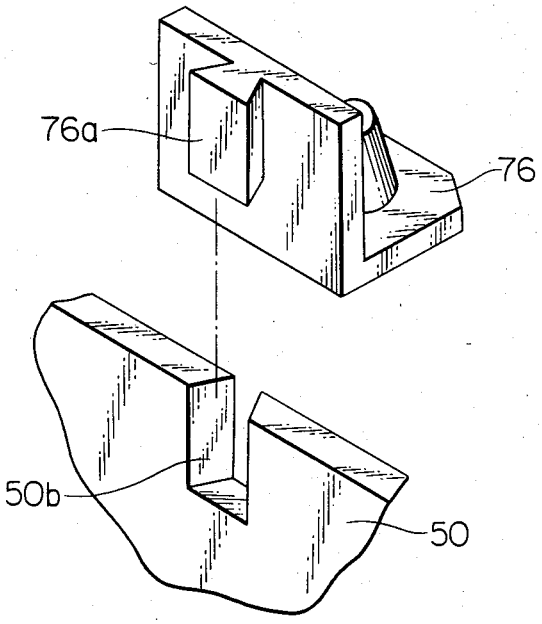

FIG. 11 is an enlarged perspective view illustrating a tripping spring bearing 76. The fixing is effected by fitting its protrusion 76*a* into a dovetail groove 50*b* disposed on the mounting pedestal 50 with the tripping spring 42 compressed and disposed between the spring bearing 76 and the lower surface of the cross bar 43 to always urge the cross bar 43 in an upward direction.

The electromagnetic contactor of the present embodiment constructed as described above is constructed so that the stationary iron core 47 is formed of a magnetic bar-shaped member while the movable iron core 44 disposed oppositely on the lateral side thereof is made up into the form of U and during the attraction of the iron cores, that portion of the operating coil 35 on the side of the movable iron core is accommodated in a recessed portion of said movable iron core 44. This permits a space for mounting the rectifier circuit to be sufficiently ensured within the mounting pedestal 50.

Moreover, the stationary iron core 47 is laid by its side during the assembling and the stationary iron core support 75 for positioning this stationary iron core 47 is made up into the form of a gate. Thus after the electromagnetic contactor has been assembled, the insertion and removal of the stationary iron core 47 can be effected through a gate type inner space of the stationary iron core support 75. At that time, the contact pole surface thereof can readily be distinguished from the lower surface thereof because the sectional profile of the stationary iron core 47 is made up into the form of the trapezoid.

In the electromagnetic contactor of the present embodiment, the wiring of the rectifier circuit shown in FIG. 2 for the operating coil 35 is entirely effected within the printed substrate 61 without the lead wiring used and furthermore, the operating coil 35 and the change-over switch 31 are arranged to be capable of being directly mounted on the printed substrate 61. Moreover, their positions and heights can readily be set by the screws 65. Thus their ability to be assembled is much improved to render the entire device inexpensive.

Furthermore, in the electromagnetic contactor of the present embodiment, the electronic components 30, 33, 32 and 34 and the wiring specification for the operating coil 35 in FIG. 2 have constants which are changed with variations in driving voltage. However, all of them are fixed within the mounting pedestal 50 by means of a potting molding material 71, for example, an epoxy resin or the like. Thus, when the user reconstructs the device at a different driving voltage, the reconstruction can be very conveniently effected because replacement of the mounting pedestal 51 alone can be performed without any erroneous combination of the electronic components with the operating coil 35.

Also, since the electromagnetic contactor of the present embodiment includes the change-over switch 31 fixed to the mounting pedestal 50 by the screws 65 and having an accurate changing-over position, there is the effect that the stability of the operation is obtained.

Figure 12:
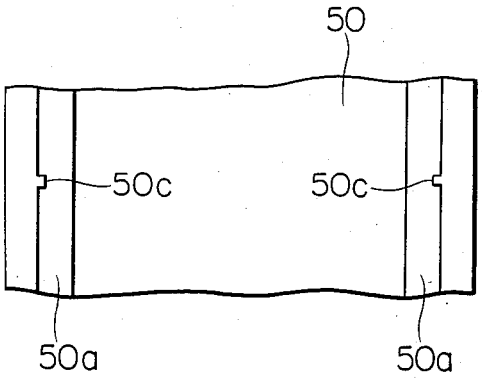
FIG. 12 is a plan view illustrating that portion of a printed substrate inserted into the mounting pedestal according to another embodiment of the present invention.
Figure 13:
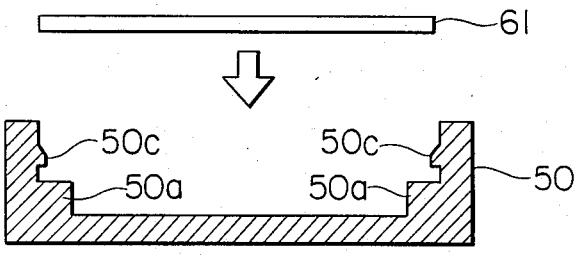
FIG. 13 is a sectional view of the mounting pedestal of FIG. 12.

Furthermore, the above described embodiment has the printed substrate 61 mounted to the mounting pedestal 50 by the screws 65 and fixed by the pouring molding material 71, but it may be fixed by disposing protrusions 50*c* having tilted surfaces narrow in width at several position on a seat 50*a* for the mounting pedestal 50 as shown in FIGS. 12 and 13, setting a dimension between the tops of these protrusions 50*c* to be smaller than that of the printed substrate 61 and utilizing the flexibility of this printed substrate 61 permit the insertion.

As described above, and according to the present invention, the stationary iron core has been composed of a bar-shaped magnetic member while the movable iron core disposed oppositely thereto has been made up into the form of a U. Thus, an electromagnetic contactor can be provided which improves the ability to assembly and handle the same so as to accommodate the rectifier circuit and its accessories in the interior of said mounting pedestal.

We claim:

1. An electromagnetic contactor, comprising:

a mounting pedestal having a plurality of lateral walls including opposite first and second lateral walls, said first and second lateral walls having respective opposite openings therein;

a straight bar-shaped stationary iron core mounted on a central portion of said mounting pedestal between said opposite openings and having cross-sectional dimensions less than those of at least one of said opposite openings so as to be fittable therethrough;

a pair of iron core supports disposed in said openings so as to mount respective opposite ends of said stationary iron core therein;

an operating coil surrounding said stationary iron core;

an inverted U-shaped movable iron core, said movable iron core being formed of a pair of leg portions, each having first ends facing said stationary iron core on opposite sides of said operating coil, and second ends opposite said first ends, and a bridge portion connecting said second ends, said movable iron core being disposed oppositely to said stationary iron core so that said first ends of said movable iron core are movable toward and away from said stationary iron core so as to be contactable with and separable from said stationary iron core on said opposite sides of said operating coil, respectively in response to energization and deenergization of said operating coil; and a substrate in the vicinity of said stationary iron core fixed in said mounting pedestal, said substrate having mounted thereon:

a rectifier circuit means, electrically connected to said coil, for rectifying an alternating current applied thereto so as to provide a direct current to said coil, a change-over switch connected to said rectifier means, for being closed in the absence of the alternating current and for being open when the stationary iron core is connected to said movable iron core, and a voltage dropping circuit, connected to said rectifier in parallel with said change-over switch, for suppressing a voltage applied to said coil;

said rectifier circuit, said change-over switch and said voltage dropping circuit being disposed in a space formed between said stationary iron core and one of said plurality of lateral walls on a side of said stationary core opposite said movable iron core.

2. An electromagnetic contactor according to claim 1, wherein said stationary iron core has a cross section in the shape of a trapezoid.

3. An electromagnet contactor according to claim 2, wherein said mounting pedestal has a support unit in the interior of said mounting pedestal elastically receiving said stationary iron core, a base forming with said mounting pedestal a case for the entire electromagnetic contactor, said base having disposed thereon an another iron core support, disposed so that said stationary iron core is carried by said another iron core support and said support unit, a portion of each of said iron core supports having a convex surface abutting against said stationary iron core.

4. An electromagnetic contactor according to claim 3, wherein said another iron core support has a leg part extending to said abutting convex surface and opposing a lateral surface of said stationary core.

5. An electromagnetic contactor according to claim 3, wherein said another iron core support has an elastically deformable leg part having a pawl, and is disposed on said base by this leg part.

6. An electromagnetic contactor according to claim 2, wherein a contact pole surface of said stationary iron core has a non-magnetic spacer stuck thereto.

7. An electromagnetic contactor according to claim 1, wherein said first and second lateral walls are different from said one of said plurality of lateral walls.

8. An electromagnetic contactor according to claim 1 wherein said change-over switch said substrate is fixed at a predetermined position on said mounting pedestal.

9. An electromagnetic contactor according to claim 8, further comprising a cross bar driven by said movable iron core, part of said cross bar alternately abutting and separating from a pushbutton part of said change-over switch, thereby to operate said change-over switch.

10. An electromagnetic contactor according to claim 1, further comprising a spring for imparting a separating force between said movable iron core and said stationary iron core, and a cross bar driven by said movable iron core, said spring being disposed between said cross bar and said mounting pedestal, said electromagnetic contactor further comprising a spring bearing for supporting one end of said spring, fitted into and disposed on said mounting pedestal.

11. An electromagnetic contactor according to claim 10, wherein a groove is formed on a lateral surface part of said mounting pedestal and a protrusion is formed on said spring bearing, said protrusion being fitted into said groove thereby to dispose said spring bearing on said mounting pedestal.

12. An electromagnetic contactor according to claim 1, wherein said substrate is fixed on said mounting pedestal by resin potting molded to form an unitary structure.

* * * * *